US006467873B1

(12) United States Patent
Toba et al.

(10) Patent No.: US 6,467,873 B1
(45) Date of Patent: Oct. 22, 2002

(54) INK JET RECORDING APPARATUS

(75) Inventors: Koichi Toba, Nagano (JP); Norihiro Maruyama, Nagano (JP); Nobuhito Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/635,142

(22) Filed: Aug. 9, 2000

(30) Foreign Application Priority Data

Aug. 9, 1999 (JP) ..... 11-225507
Oct. 15, 1999 (JP) ..... 11-294399

(51) Int. Cl.[7] ..... B41J 2/165
(52) U.S. Cl. ..... 347/33
(58) Field of Search ..... 347/33, 22, 32, 347/34, 31; 15/250.361, 256.5

(56) References Cited

U.S. PATENT DOCUMENTS 5,381,169 A * 1/1995 Arai et al. ..... 347/33
5,396,277 A * 3/1995 Gast et al. ..... 347/33
5,896,143 A * 4/1999 Matsui et al. ..... 347/24
5,949,448 A * 9/1999 Man et al. ..... 347/33
5,984,452 A * 11/1999 Bekki ..... 347/33
6,189,999 B1 * 2/2001 Pham et al. ..... 347/33

FOREIGN PATENT DOCUMENTS

EP 0 494 693 A1 7/1992 ..... B41J/2/165
EP 0 709 204 A1 5/1996 ..... B41J/2/165
EP 0 841 168 A2 * 5/1998
JP 362113553 A * 5/1987 ..... 347/33
JP 03-240554 * 10/1991 ..... 327/33
JP 404043046 A * 2/1992 ..... 347/33
JP 4-67953 3/1992 ..... B41J/2/165
JP 0-6143597 * 5/1994 ..... 347/33

OTHER PUBLICATIONS

Japanese Abstract No. 03240554, dated Oct. 25, 1991, Yoji, Ink Jet Recording device.
Japanese Abstract No. 07032611, dated Feb. 3, 1995, Hiroyuki, Ink Jet Recording apparatus.
Japanese Abstract No. 07214785, dated Aug. 15, 1995, Tetsuya, Ink Jet Recording apparatus.
Japanese Abstract No. 09057993, dated Mar. 4, 1997, Masayuki, Ink Jet Recorder.
Japanese Abstract No. 07205438, dated Aug. 8, 1995, Hiroyuki, Ink Jet Recorder.
European Search Report, De Groot, R, EP 00116241, Mar. 13, 2001.
Japanese Patent Abstract 4–67953 Mar. 03, 1992, Matsui, Ink Jet Recording device.

* cited by examiner

*Primary Examiner*—Lamson Nguyen
*Assistant Examiner*—Shih-wen Hsieh
(74) *Attorney, Agent, or Firm*—Sughrue Mion, PLLC

(57) ABSTRACT

A recording head is mounted on a carriage moving in a widthwise direction of a recording medium. The recording head includes a nozzle formation face having nozzle orifices from which ink drops are ejected for recording. An elastic wiping member is provided for wiping out ink on the nozzle formation face as the carriage is moved. A buffer member is mounted on the carriage so as to be adjacent to the recording head. The buffer member has a contact face for receiving restoration force of the elastic wiping member produced by the wiping operation in order to prevent received ink from splashing therearound.

19 Claims, 10 Drawing Sheets

INK JET RECORDING APPARATUS

BACKGROUND OF THE INVENTION

The present invention relates to an ink jet recording apparatus comprising an ink jet recording head, which is mounted on a carriage that moves in the widthwise direction of a recording sheet and which ejects ink droplets through nozzle orifices. In particular, the present invention pertains to an ink jet recording apparatus that can restrict the splashing of ink that occurs due to the strength of the recovery force exerted by a wiping member, provided to wipe the nozzle formation face of the recording head.

Since ink jet recording apparatuses produce comparatively little noise during printing and can form small dots at a high density, they are currently being used for various types of printing, including color printing.

Such an ink jet recording apparatus comprises an ink jet recording head, mounted on a movable carriage, for receiving ink from an ink cartridge, and a paper feeder for moving a recording sheet relative to the recording head. To perform the printing function, while the recording head moves with the carriage in the widthwise direction of the recording sheet, ink droplets are ejected and are deposited on the recording sheet.

The recording head that is mounted on the carriage can eject black, yellow, cyan and magenta colored inks, so that not only can black be used for printing test, but also, full color printing is possible by changing the ejection ratio of the colored inks.

To print, droplets of ink are ejected under pressure, produced by a pressure generation chamber, through nozzles in the recording head mounted in the ink jet recording apparatus and are deposited on the recording sheet. Therefore, printing failures may occur as a result of a rise in ink viscosity, caused by the evaporation of solvent through the nozzle orifices, the solidification of ink, the attachment of dust particles to the nozzles, or the entry of air bubbles into the nozzle orifices.

Therefore, additional components provided for an ink jet recording apparatus comprise: a capping member, for sealing the nozzle orifices of a recording head while printing is not being performed, and a wiping member, for cleaning a nozzle plate.

The capping member serves as a lid to prevent ink from drying in the nozzle orifices of the recording head while printing is not being performed. In addition, when ink in the nozzle orifices of a recording head solidifies, clogging the nozzles, to eliminate the clogging, the capping member is used to seal the nozzle formation face while a suction pump applies a negative pressure to attract and discharge ink from the nozzle. The capping member also performs a similar function to eliminate an ink ejection failure resulting from the entry of air bubbles into the ink flow path.

The forcible ink suction and discharge process for removing clogging from a recording head and for preventing air bubbles from entering the ink flow path is called a cleaning process. This process is performed when printing is resumed after an apparatus has been halted for an extended period of time, or when a user notices a deterioration in image quality and turns on a cleaning switch.

The capping member permits the recording head to discharge ink under negative pressure, and a wiping member, which is an elastic plate, made of rubber, for example, cleans (wipes) the nozzle formation face of the recording head by wiping and scraping off ink adhering to the nozzle formation face.

In a wiping process that is performed after ink has been drawn into a recording head and discharged, a wiping member, composed, as previously mentioned, of an elastic material such as rubber, is advanced along the route traveled by the carriage on which the recording head is mounted, and wipes the nozzle formation face of the recording head as the carriage is moved.

As a result, ink adhering to the nozzle formation face of the recording head is removed and the nozzle formation face is cleaned.

In this case, the wiping member, while sliding in contact with the nozzle formation face, is appropriately bent, and the recovery force that is exerted during the wiping process is utilized to scrape ink from the nozzle formation face.

Therefore, while the carriage is being moved, at the moment at which the recording head passes beyond the location of the wiping member, the flexible recovery force of the wiping member causes the wiping member to rapidly recover to its original shape, and to splash, inside the ink jet apparatus, the ink that was scraped off the nozzle formation face.

In response to the immediate recovery effected by the wiping member, ink is splashed mainly on the capping member side, and contaminates a drive mechanism that is used to vertically move the capping member. When ink deposited on the drive mechanism solidifies, a technical problem arises, in that the ink interferes with the smooth operation of the drive mechanism, and the reliability of the apparatus is degraded.

SUMMARY OF THE INVENTION

To resolve the above shortcoming, it is one objective of the present invention to provide an ink jet recording apparatus that prevents ink retained on a wiping member from being splashed, and that can maintain the device reliability for an extended period of time.

In order to achieve the above object, according to the present invention, there is provided an ink jet recording apparatus comprising:

- a carriage moving in a widthwise direction of a recording medium;
- a recording head mounted on the carriage, and including a nozzle formation face having nozzle orifices from which ink drops are ejected for recording;
- an elastic wiping member for wiping out ink on the nozzle formation face as the carriage is moved; and
- a buffer member mounted on the carriage so as to be adjacent to the recording head, and having a contact face for receiving restoration force of the elastic wiping member produced by the wiping operation in order to prevent received ink from splashing therearound.

Preferably, the contact face of the ink remover is configured such that the distance between the nozzle formation face and the contact face of the buffer member increases so as to gradually restore the wiping member to the original shape thereof as the carriage moves.

Preferably, the contact face is a continuous slant face of a stepwise face.

Alternatively, a plurality of individual plate members, each having different length and arranged with a predetermined interval, constitute the contact face.

Preferably, the buffer member serves as an ink remover for removing the received ink on the wiping member.

Preferably, the contact face of the ink remover is configured such that the distance between the nozzle formation face and the contact face of the ink remover increases so as to gradually restore the wiping member to the original shape thereof as the carriage moves.

Preferably, the contact face is a continuous slant face or a stepwise face.

Alternatively, a plurality of individual plate members, each having different length and arranged with a predetermined interval, constitute the contact face.

Alternatively, the contact face of the ink remover is configured such that the distance between the nozzle formation face and the contact face of the ink remover decreases so as to further deform the wiping member as the carriage moves.

Preferably, the contact face is a continuous slant face or a stepwise face.

Alternatively, a plurality of individual plate members, each having different length and arranged with a predetermined interval, constitute the contact face.

Alternatively, a plurality of individual plate members, each having an identical length and arranged with a predetermined interval, constitute the contact face.

Alternatively, the contact face includes a groove. The contact face is configured such that the wiping member is momentarily restored to the original shape thereof, and ink splashed from the wiping member due to the restoration thereof is received by the groove.

According to the above configurations, the wiping member, immediately after cleaning the nozzle formation face of the recording head, slides in contact with the buffer member or the ink remover, and ink scraped off the nozzle formation face is removed.

Therefore, the problem encountered when ink scraped off the nozzle formation face is splashed within the apparatus, due to the restoration force of effected by a wiping member, can be eliminated.

Preferably, at least the contact face of the ink remover is made of a material capable of absorbing ink.

In this case, the ink absorption part absorbs or temporarily holds ink so that the removed ink can be naturally dried thereat.

As a result, the problem encountered when the driving mechanism for vertically moving a capping member is contaminated with ink can be eliminated, and operational reliability can be guaranteed for an extended period of time.

Preferably, the buffer member is mounted in an attachment area defined between a pair of guide protrusions formed on the carriage with a screw member screwed into the carriage while piercing the buffer member.

Preferably, the position of the buffer member in the carriage moving direction is determined by the position of the pair of guide protrusions. The buffer member includes a first positioning member to be engaged with one of the guide protrusions to determine the position of the buffer member in a direction perpendicular to the carriage moving direction.

Preferably, the buffer member includes a second positioning member to be engaged with one of the guide protrusions to determine the position of the buffer member in a direction orthogonal to a mount face of the attachment area, and a through hole, through which the screw member is inserted, formed to be adjacent to the other one of the guide protrusions to determine the position of the contact face.

According to the above configurations, the positioning and the attachment of the buffer member are quite easy, and this contributes. to an increase in productivity. Further, since the protrusion on the buffer member engages the guide protrusions at this time, the buffer member can also be positioned in the direction perpendicular to the carriage moving direction.

Furthermore, the contact face of the buffer member relative to the carriage can be uniquely defined, so that an excellent contact condition of the wiping member can be maintained, without product variances occurring.

Preferably, the ink jet recording apparatus further comprises a capping member for capping the nozzle formation face. The buffer member is located in a side close to the capping member with respect to the recording head.

The nozzle formation face of the recording head is sealed by the capping member, and a cleaning process is performed to attract and discharge ink using the negative pressure produced by a suction pump. Thereafter, as the carriage is moved to the printing area, the wiping member wipes off ink adhering to the nozzle formation face.

At this time, since the wiping member, which is bent while in contact with the recording head, gradually recovers to its original shape while sliding along the inclined face of the ink remover, a problem encountered when ink scraped off a nozzle formation face is splashed within an apparatus can be eliminated.

DETAILED DESCRIPTION OF THE PREFERRED EMBODIMENTS

Figure 1:
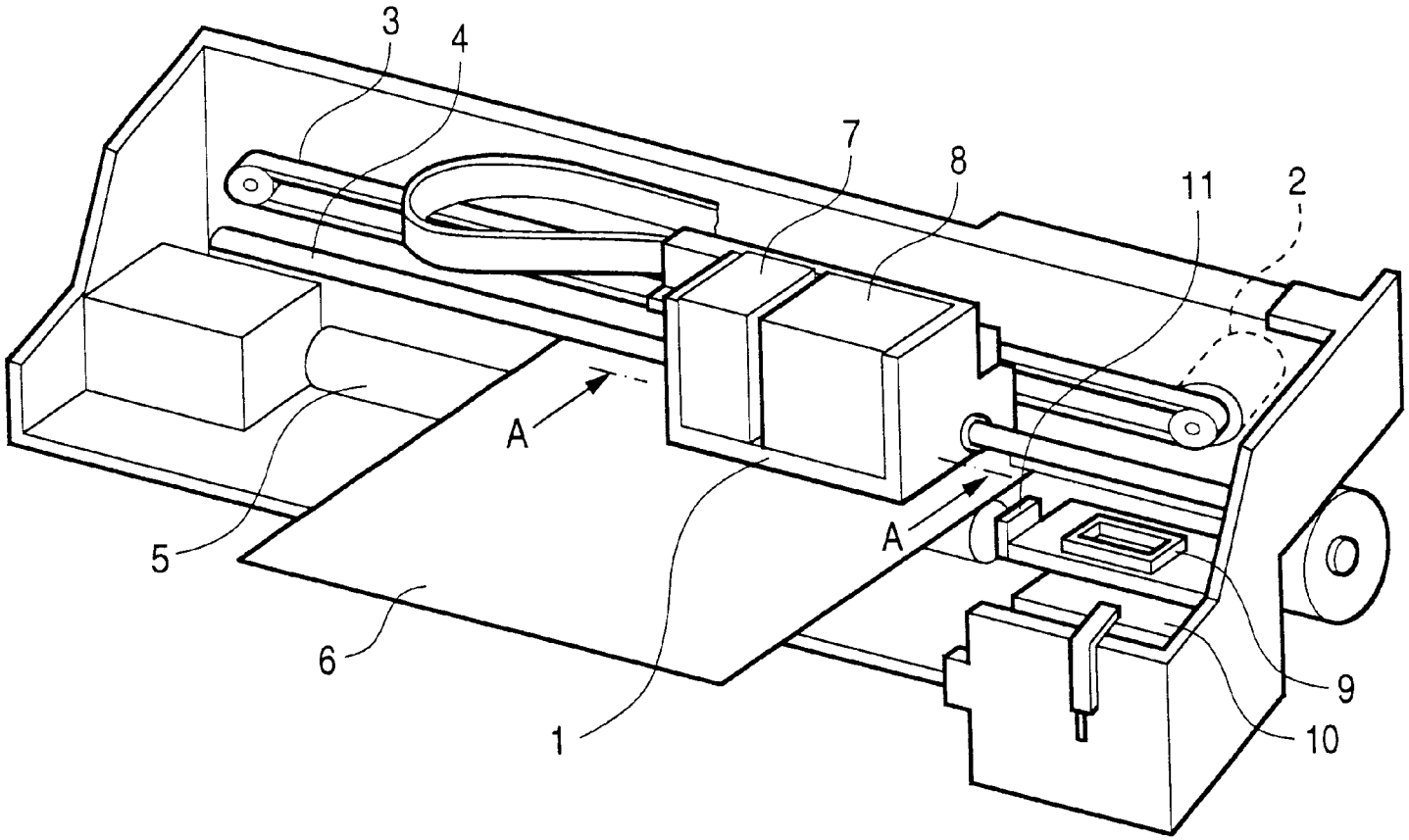
FIG. 1 is a perspective view of the general arrangement of an ink jet recording apparatus according to the invention.

An ink jet recording apparatus according to the invention will now be described while referring to the accompanying drawings. In FIG. 1, a carriage 1 is moved along a guide member 4 by a timing belt 3, which is driven by a carriage motor 2, and reciprocally scans in the axial direction of a platen 5.

An ink jet recording head, which will be described later, is mounted on the bottom of the carriage 1 that faces a recording sheet 6, and a black ink cartridge 7 and a color ink cartridge 8, for supplying ink to the recording head, are detachably mounted on the carriage 1.

A capping member 9 is located in a non-printing area (at a home position). When the recording head that is mounted on the carriage 1, and which will be described later, reaches a position immediately above the capping member 1, the capping member 1 is raised to seal the nozzle formation face of the recording head. A suction pump 10 located below the capping member 9 produces a negative pressure that is applied the capping member 9.

The capping member 9 serves as a lid to prevent the nozzle orifices of the recording head from drying while the recording apparatus is not in use. In addition, the capping member functions as an ink reservoir in a flushing operation during which a drive signal that is not related to printing is transmitted to the recording head to pre-eject ink droplets. Also, the capping member 9 serves as a cleaner for applying the negative pressure produced by the suction pump 10 to the recording head to attract ink.

A wiping member 11, which is a flexible plate made of rubber, is located in the vicinity of the printing area of the capping member 9, so that it can be advanced or retracted horizontally. When the carriage 1 is moved to and away from the capping member 9, the wiping member 11 moves forward, as needed, following the route along which the recording head is moved, and wipes the nozzle formation face of the recording head.

Figure 2:
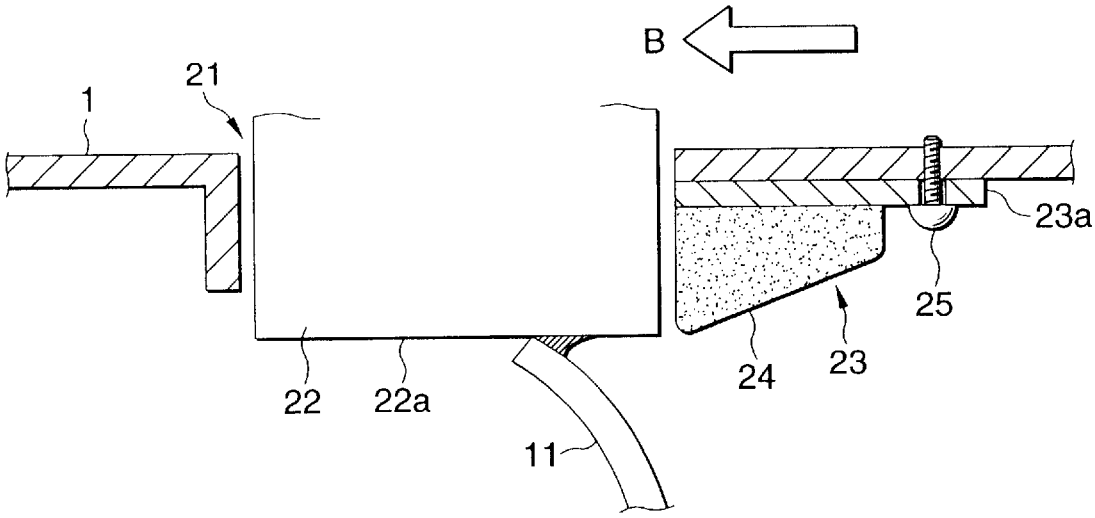
FIG. 2 is a cross-sectional view of an ink remover according to a first embodiment of the invention.

An ink jet recording head according to a first embodiment of the invention will now be described. FIG. 2 is an enlarged cross-sectional view taken along a line A—A shown in FIG. 1.

As is shown in FIG. 2, a rectangular opening 21 is formed substantially in the center of the bottom of the carriage 1, and a recording head 22 is mounted in the carriage 1 so that it extends downward through the opening 21.

An ink remover 23 is located on the home position side of the apparatus adjacent to the recording head 22. The ink remover 23 has an inclined face 24 configured such that the distance from a nozzle formation face 22*a* is gradually changed in the direction in which the carriage 1 is displaced.

The ink remover 23 is secured, for example, by a machine screw 25 to a base plate 23*a*, which is attached to the carriage 1. The entire ink remover 23 constitutes an ink absorber, and is composed of a porous material such as foamed plastic.

In the example in FIG. 2, the wiping member 11, which contacts the nozzle formation face 22*a*, of the recording 22, is bent, and as the carriage 1 is displaced in the direction indicted by an arrow 8, slides along the inclined face 24 of the ink,remover 23 and gradually recovers to its original shape.

According to this arrangement, as the carriage 1 is displaced in the direction indicated by the arrow B, the wiping member 11, which contacts the nozzle formation face 22*a* of the recording head 22, is bent. Then, while it slides across the nozzle formation face 22*a*, pressure produced by its attempt to recover to its original shape drives it against the nozzle formation face 22*a* and it scrapes off the ink adhering to that surface.

Then, as the carriage 1 is further displaced. in the direction indicated by the arrow B, the distal end of the wiping member 11 comes into contact with and slides along the inclined face 24 of the ink remover 23, gradually recovering to its original shape. At this time, the ink scraped off the nozzle formation face 22*a* is absorbed by the ink remover 23, which is composed of a porous material, and this process continues until the wiping member 11 separates from the ink remover 23 and fully recovers to its original shape.

Figure 3:
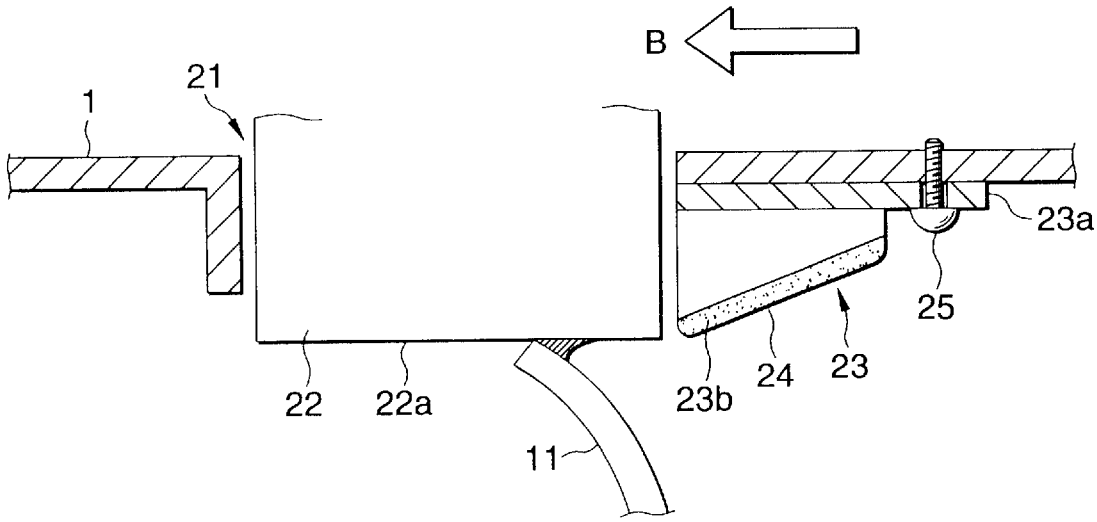
FIG. 3 is a cross-sectional view of an ink remover according to a second embodiment of the invention.

FIG. 3 is a cross-sectional view of an ink remover according to a second embodiment of the invention. The same reference numerals as are used in FIG. 2 are used to denote corresponding or identical components in FIG. 3, and no further explanation for them will be given.

In the example in FIG. 3, as compared with the example in FIG. 2, a sheet of material, which is affixed by an adhesive to the inclined ink remover 23, is used to provide an ink absorption layer 23*b*, the outer surface of which constitutes the inclined face 24. In FIG. 3, substantially the same effects can be obtained as in FIG. 2 (the first embodiment).

Figure 4:
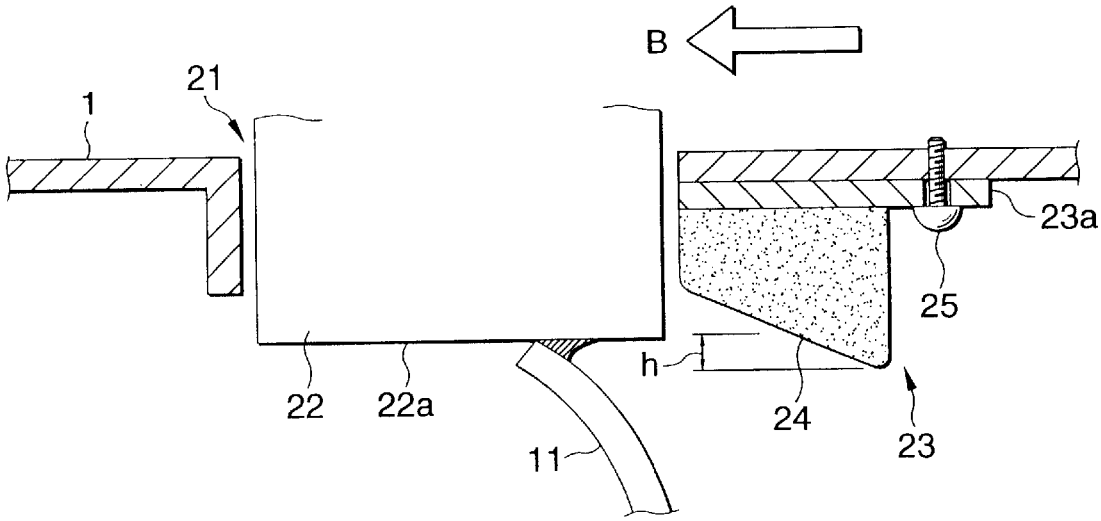
FIG. 4 is a cross-sectional view of an ink remover according to a third embodiment of the invention.

FIG. 4 is a cross-sectional view of an ink remover according to a third embodiment. The same reference numerals are used to denote corresponding components in FIG. 4, and no further explanation for them will be given.

In the example in FIG. 4, the inclined face 24 of the ink remover 23 is so provided that as the carriage 1 continues to be move in the direction indicated by the arrow B, the wiping member 11. is bent more than when it is in contact with the nozzle formation face 22*a* of the recording head 22. That is, the inclination of the inclined face 24 is the opposite of that in the example in FIG. 2.

With this arrangement, as the carriage 1 is displaced in the direction indicated by the arrow B, the wiping member 11, which contacts the nozzle formation face 22*a* of the recording head 22, is bent and is driven upward, by pressure produced by its attempt to recover to its original shape, so that as it slides across the nozzle formation face 22*a* it scrapes off ink adhering to that surface.

When the carriage 1 is further displaced in the direction indicated by the arrow B, the distal end of the wiping member 11 contacts and slides across the inclined face 24 of the ink remover 23, and the degree of the bend of the wiping member 11 is increased by a magnitude corresponding to the height denoted by h in FIG. 4.

That is, the force with which the wiping member 11 is driven against the inclined face 24 is increased, and ink scraped off the nozzle formation face 22*a* is fully absorbed by the ink remover 23, which is composed of a porous material, so that all the ink is removed before the wiping member 11 recovers to its original shape.

Figure 5:
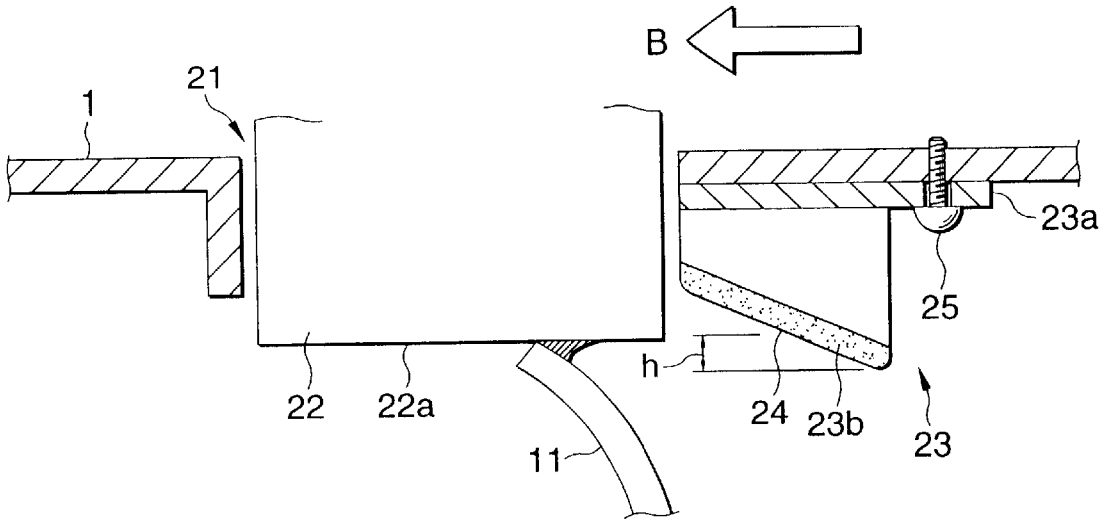
FIG. 5 is a cross-sectional view of an ink remover according to a fourth embodiment of the invention.

FIG. 5 is a cross-sectional view of an ink remover according to a fourth embodiment of this invention. The same reference numerals as are used in preceding figures are used to denote corresponding components in FIG. 5, and no further explanation for them will be given.

In the example in FIG. 5, as compared with the example in FIG. 4, a sheet of material, which is affixed by and adhesive to the inclined ink remover 23, is used to provide an ink absorption sheet layer 23*b*, the outer surface of which constitutes the inclined face 24. In this example, substantially the same effects can be obtained as in FIG. 4.

Figure 6:
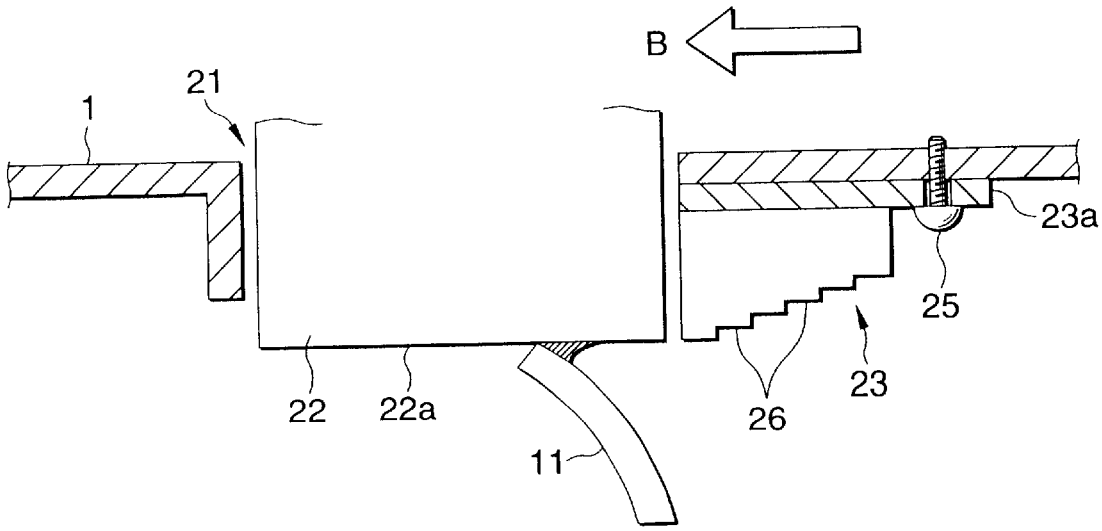
FIG. 6 is a cross-sectional view of an ink remover according to a fifth embodiment of the invention.
Figure 7:
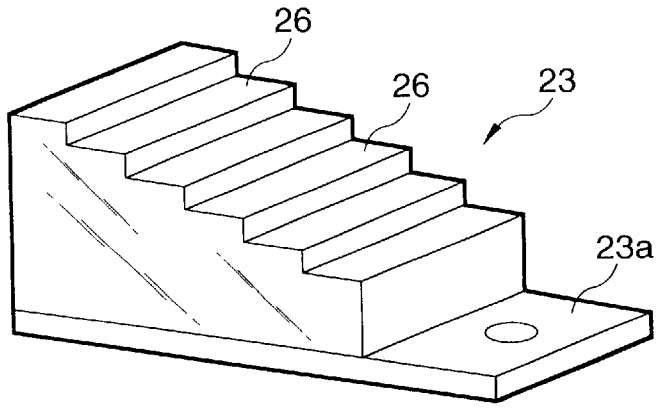
FIG. 7 is a perspective view of the ink remover shown in FIG. 6.

An ink remover according to a fifth embodiment of this invention is shown in FIGS. 6 and 7. FIG. 6A is a cross-sectional view and FIG. 7 is a perspective view of the structure of the ink remover. The same reference numerals as are used in preceding figures are used to denote corresponding components in FIG. 6, and no further explanation for them will be given.

In the example in FIGS. 6 and 7, the ink remover 23 is configured such that the distance between a contact face thereof and the nozzle of formation face 22*a* is stepwisely changed in the direction in which the carriage 1 is displaced (direction indicated by an arrow B).

In this example, the wiping member 11, which contacts the nozzle formation face 22*a* of the recording head 22, is bent, and as the carriage 1 is moved in the direction indicated by the arrow B, it slides across each step 26 of the ink remover 23 until it recovers to its original shape.

The ink remover 23 is composed of a synthetic resin. Each time the wiping member 11 slides across one of the steps 26, ink is scraped it at the perpendicular ridge lines and at ridge lines that are orthogonal to the horizontal direction.

In the example in FIGS. 6 and 7, the wiping member 11, which contacts the nozzle formation face 22*a*, is bent, and as the carriage 1 is displaced, it gradually recovers to its original shape as it slides across the steps 26. However, while the wiping member 11 is sliding across the steps 26, its bend may increase instead decrease.

When the bend in the wiping member 11 is increased, the force with which the wiping member 11 is pressed against the steps 26 is also increased, and the removal from the wiping member 11 of the ink scraped off the nozzle formation face 22*a* is enhanced.

It is also effective if the ink remover 23, with which, for example, surface locations are changed stepwisely, were composed of a porous, ink-absorbent material, as was explained while referring to FIG. 2 or 4.

Figure 8:
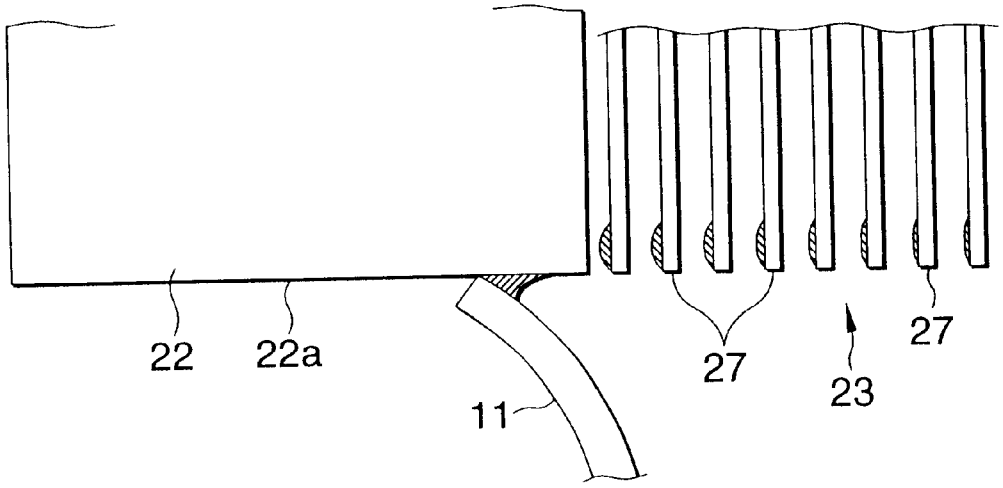
FIG. 8 is a cross-sectional view of an ink remover according to a sixth embodiment of the invention.
Figure 9:
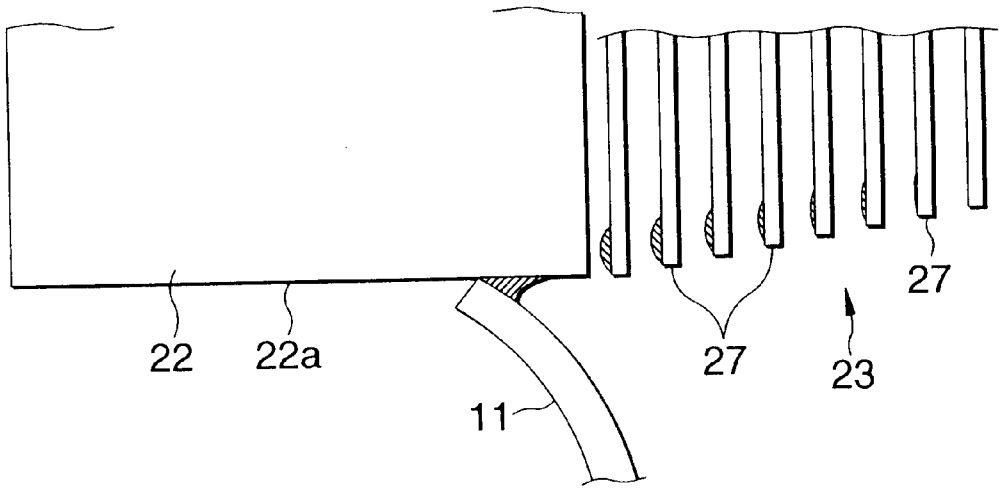
FIG. 9 is a cross-sectional view of an ink remover according to a seventh embodiment of the invention.
Figure 10:
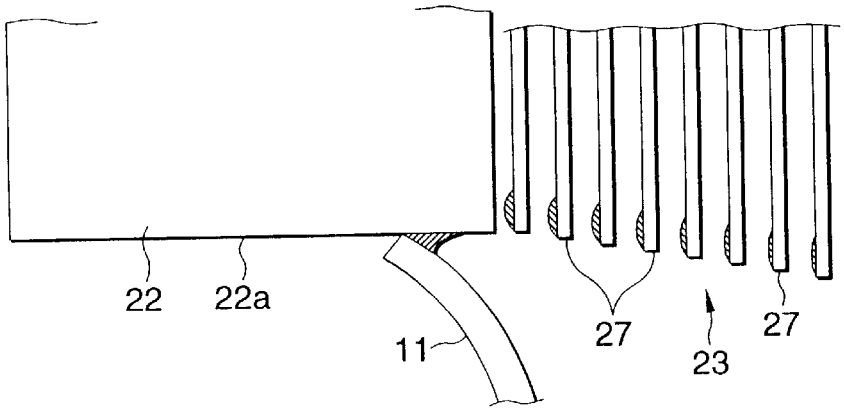
FIG. 10 is a cross-sectional view of an ink remover according to an eighth embodiment of the invention.

FIGS. 8 to 10 are cross-sectional views of ink removers according to sixth to eighth embodiments of the invention. In the examples in FIGS. 8 to 10, as the ink remover 23, a plurality of plates 27 are positioned in line at substantially the same intervals.

In this case, as the carriage 1 is displaced, the wiping member 11 sequentially slides along in contact with the respective ends of the plates 27.

In the sixth embodiment in FIG. 8, the lower ends of the plates 27 are formed substantially on the same plane as the nozzle formation face 22*a* of the recording head 22. Thus, some of the ink that is scraped off the nozzle formation face 22*a* is removed by the individual plates 27 each time their ends are contacted by the wiping member 11.

In the seventh embodiment in FIG. 9, as the carriage 1 is displaced, the bent wiping member 11 gradually recovers to its original shape while sequentially sliding across the ends of the individual plates 27.

Further, in the eighth embodiment in FIG. 10, as the carriage 1 is displaced, the bend in the wiping member 11 is increased, while the wiping member 11 sequentially slides across the ends of the individual plates 27.

Thus, the force with which the wiping member 11 contacts the ends of the individual plates 27 is increased, and the removal of ink from the wiping member 11 can be enhanced.

Figure 11:
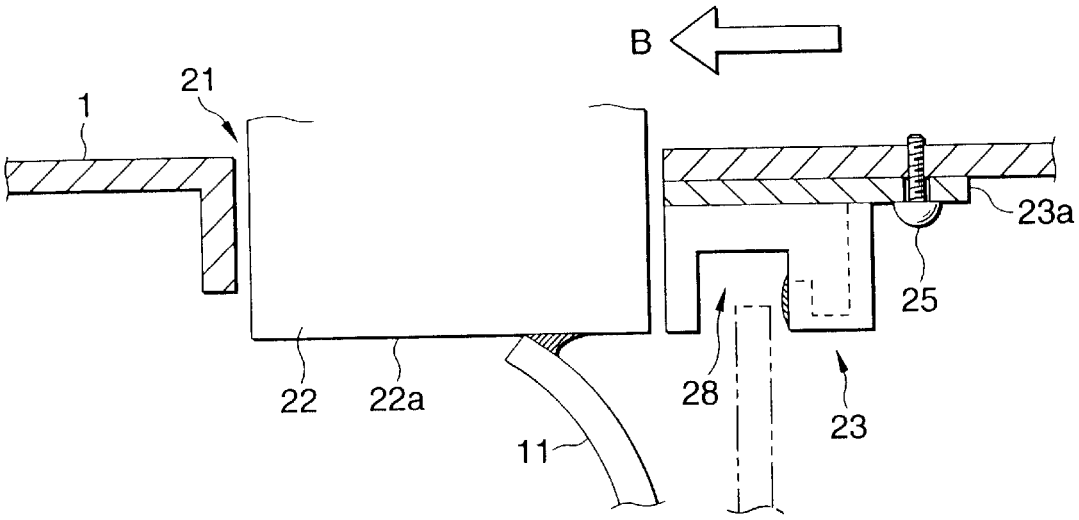
FIG. 11 is a cross-sectional view of an ink remover according to a ninth embodiment of the invention.

FIG. 11 is a cross-sectional view of an ink remover according to a ninth embodiment of the invention. The same reference numerals as are used in preceding figures are used to denote corresponding components in FIG. 11, and no further explanation for them will be given.

In the example in FIG. 11, a groove 28 is formed in the ink remover 23. The wiping member 11, which contacts the nozzle formation face 22*a*, of the recording head 22, is bent, but momentarily recovers to its original shape as the carriage 1 is displaced, and ink that was scraped off and is held by the wiping member 11 is splashed and collected in the groove 28.

That is, as the carriage 1 is displaced in the direction indicated by an arrow B, the bend wiping member 11 reaches the groove 28 formed in the ink remover 23, and as is indicated by imaginary lines, the wiping member 11, driven by the strength of its recovery force, momentarily recovers to its original shape while in the groove 28.

Due to the recovery action, the ink attached to the wiping member 11 is splashed and collected inside the groove 28.

As the carriage 1 is further displaced, the wiping member 22 again contacts the ink remover 23, and thereafter recovers to its original shape. At this time, however, almost no ink is attached to the wiping member 11, so that splashing of ink onto the capping member 9 is reduced.

The arrangement is not limited to this configuration, and the effect obtained by the ink remover 23 in FIG. 11 can be improved if it is formed of porous, ink absorbent material.

As is apparent from the above explanation, according to the configurations of the above embodiments, the ink remover is located adjacent to the recording head on the carriage, and removes ink that has been scraped off the nozzle formation face of the recording head and is attached to the wiping member. Thus, the inconvenience of having ink, which is scraped off the nozzle formation face of the recording head, being splashed at random by the wiping member can be prevented.

Therefore, the conventional problem that arises when the operation of the driving mechanism is interrupted by the solidification ink that is freely splashed into the apparatus can be eliminated, and the stable operation of the recording apparatus can be guaranteed for an extended period of time.

An ink jet recording apparatus according to a tenth embodiment of the invention will now be described. In this embodiment, the ink jet recording apparatus comprises a buffer member 31 located on the home position side adjacent to a recording head 22, and configured such that the distance from a nozzle formation face 22*a* of the recording head 22 is gradually changed in the direction in which the carriage 1 is displaced, and a holder for holding the buffer member while attaining precise positioning thereof.

Figure 12:
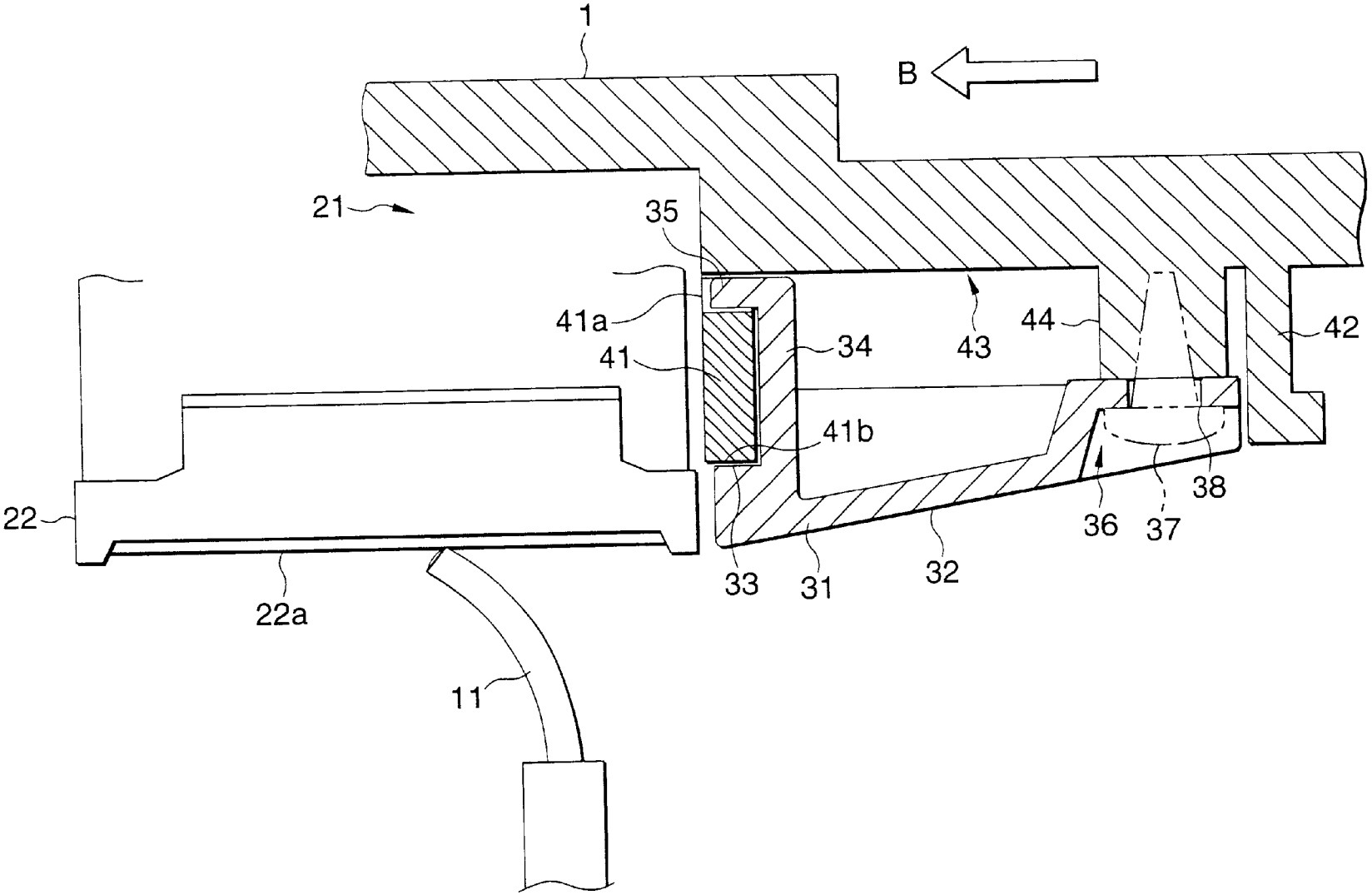
FIG. 12 is an enlarged cross-sectional view of an ink remover according to a tenth embodiment of the invention, taken along the line A—A shown in FIG. 1.

FIG. 12 is an enlarged cross-sectional view of the ink jet recording apparatus of the tenth embodiment, taken along a line A—A shown in FIG. 1.

As is shown in FIG. 12, a rectangular aperture 21 is formed substantially in the center of the bottom of the carriage 1, and the recording head 22 is mounted on the carriage 1 and is fitted into the aperture 21.

The external appearance of the buffer member 31 is shown in FIGS. 13 to 16. The buffer member 31 may be integrally formed of synthetic resin, or as previously explained for the ink remover of the first embodiment, a porous material, such as foamed plastic, that absorbs ink may be fixed to the inclined surface with adhesive.

Figure 14:
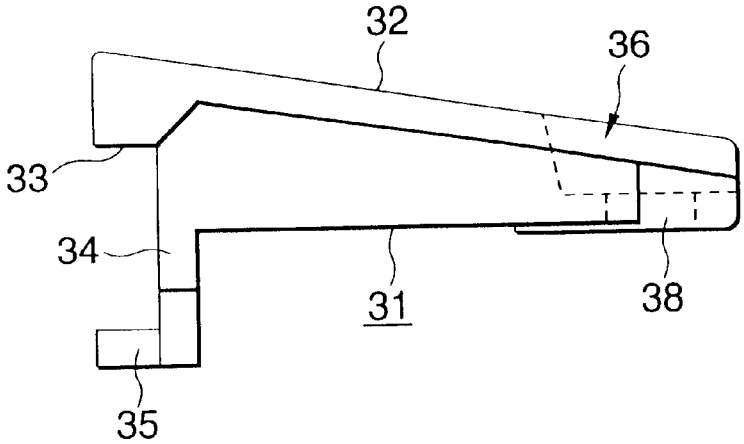
FIG. 14 is a bottom view of the ink remover shown in FIG. 13.
Figure 15:
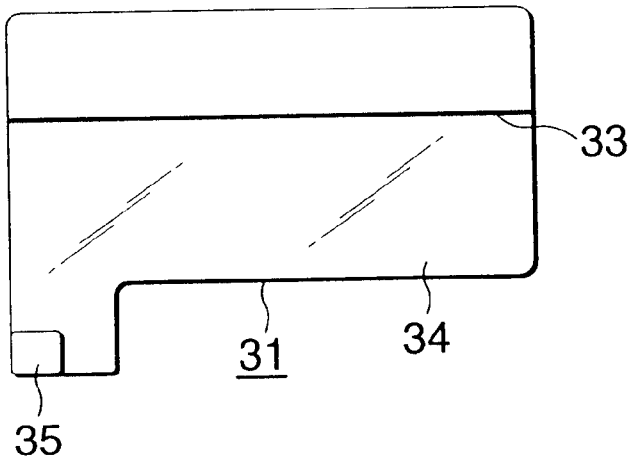
FIG. 15 is a left side view of the ink remover shown in FIG. 13.

As is shown in FIG. 14, a step 33, formed at one end (the left end in FIG. 14) of the buffer member 31, contacts the projected end of one of several guide protrusions that will be described later. Further, as is shown in FIGS. 14 and 15, a protrusion 35 is integrally formed with and projects horizontally from a perpendicular wall member 34.

Figure 13:
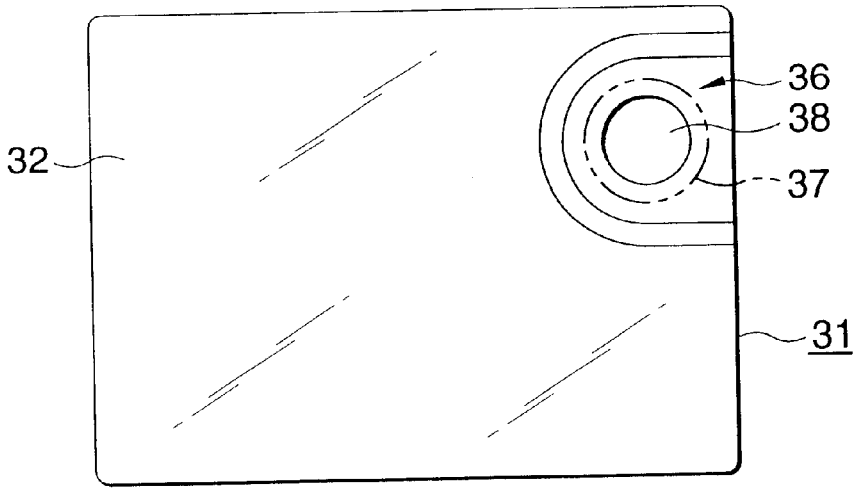
FIG. 13 is a front view of the ink remover shown in FIG. 12, viewed from an inclined face.
Figure 16:
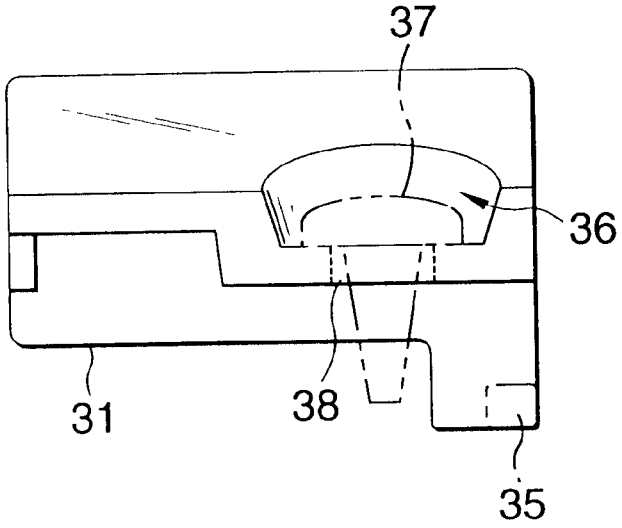
FIG. 16 is a right side view of the ink remover shown in FIG. 13.

As is shown in FIGS. 13, 14 and 16, a recessed portion 36 is formed at the other end (the right end in FIG. 13) of the buffer member 31, and opens toward the inclined face 32. A through hole 38 is formed substantially in the center of the recessed portion 36, and a machine screw 37 that engages the carriage side and that will be described later is inserted into the through hole 38.

Figure 17:
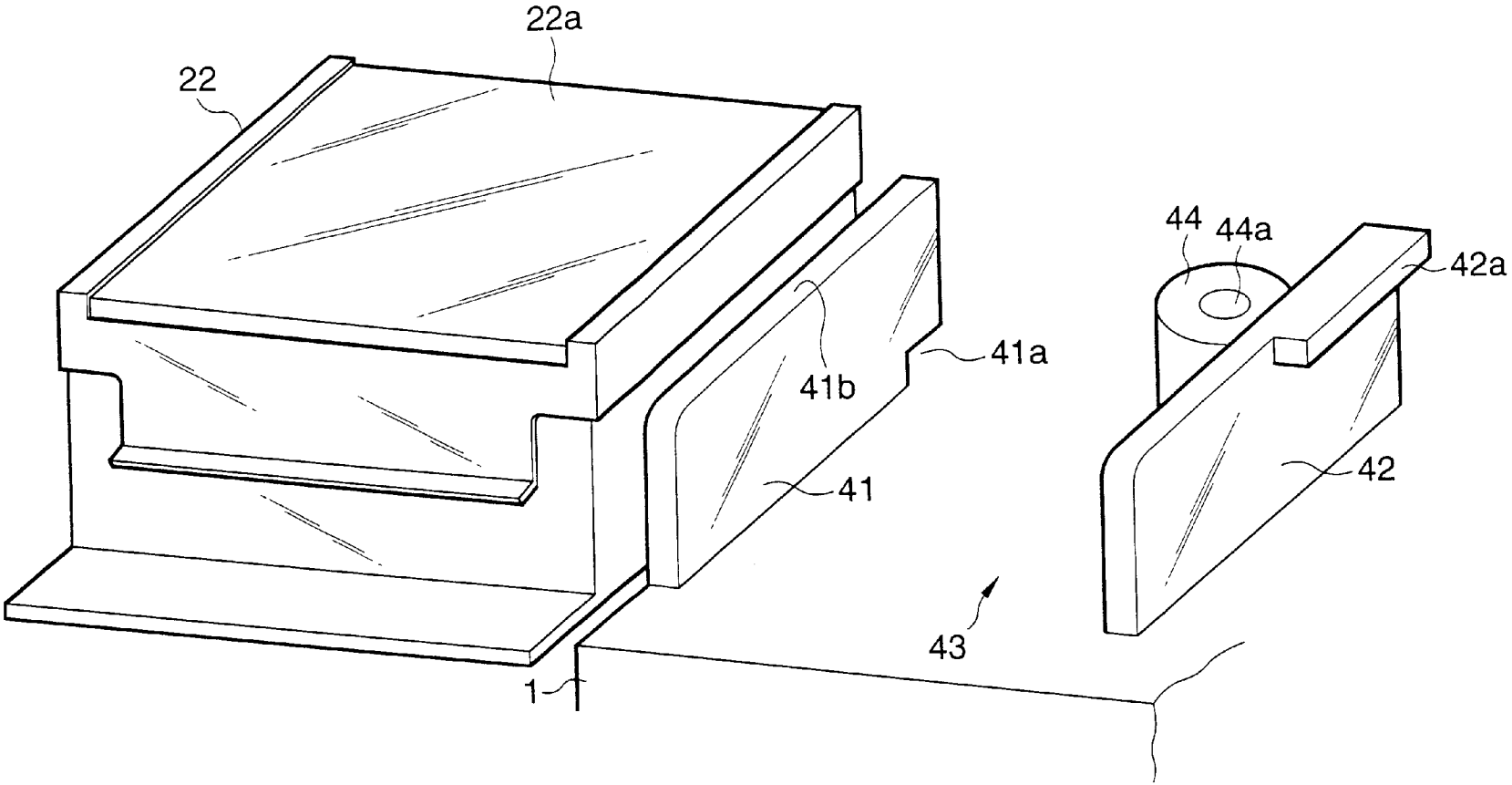
FIG. 17 is a perspective view of the structure of one pair of guide protrusions when the ink remover of the tenth embodiment is removed.

FIG. 17 is a perspective view, with the buffer member 31 is removed, of the structure of the pair of guide protrusions that are integrally formed with the carriage 1.

As is shown in FIG. 17, a first and a second guide protrusion 41 and 42 are integrally formed with the carriage 1 at predetermined intervals in the direction in which the carriage 1 is displaced, and are adjacent to the recording head 22, which is mounted on the bottom of the carriage 1.

The first guide protrusion 41 is located near the recording head 22, while, in the direction in which the carriage 1 is displaced, the second guide protrusion 42 is located on the home position side whereat the capping member 9 is located.

Both of the guide protrusions 41 and 42 are shaped like plates, and are upright and parallel to each other. An area 43 for the attachment of the buffer member 31 is defined between the guide protrusions 41 and 42.

A groove-shaped notch 41*a* is formed in the rising edge of the first guide protrusion 41, which is adjacent to the recording head 22. An engagement portion 42*a* is horizontally formed in the area extending from the longitudinal center to the edge at the projected end of the second guide protrusion 42, which is located on the home position side.

As the carriage 1 is displaced toward the home position, the engagement portion 42*a* engages a one part of a support member (not shown) that supports the capping member 9, and raises the capping member 9 toward the recording head 22. Thus, the nozzle formation face 22*a* of the recording head can be sealed by the capping member 9.

Further, in the area 43, for attachment of the buffer member 31, an upright, cylindrical strut 44 is integrally formed with the carriage 1 at a position near the second guide protrusion 42, and a shaft hole 44*a* is formed extending downward from the top of the strut 44 in the axial direction.

The machine screw 37, which passes through the through hole 38 formed in the buffer member 31, is fitted into the shaft hole 44*a*, so as to attach the buffer member 31 to the carriage 1.

With this arrangement, the buffer member 31 in FIGS. 13 to 16 is located in the attachment area 43, which is defined between the pair of guide protrusions 41 and 42 that are formed on the carriage 1, as is shown in FIG. 12. Then, the machine screw 37 is inserted through the through hole 38 formed in the buffer member 31 and is fitted into the strut 44 formed on the carriage side, so as to secure the buffer member 31 to the carriage 1.

In this case, the guide protrusions 41 and 42 position the buffer member 31 in the direction in which the carriage 1 is displaced.

When the buffer member 31 is slid so that the step 33 formed on the buffer member 31 is guided along the projected end 41*b* of the first guide protrusion 41, the protrusion 35 of the buffer member 31 engages the groove-shaped-notch 41*a* that is formed in the upright edge of the guide protrusion 41. As a result, the buffer member 31 can be positioned in perpendicular to the direction in which the carriage 1 is displaced.

That is, the sizes of the through hole 38 that is formed in the buffer member 31 and the shaft hole 44*a* in the strut 44 that is formed on the carriage side substantially match.

Therefore, when the machine screw 37 is inserted through the through hole 38 of the buffer member 31 and is fitted into the shaft hole 44*a* formed in the strut 44 on the carriage side, the buffer member 31 can be precisely secured in the attachment area 43 that is defined in the carriage 1.

In this case, as is described above, the end of. the buffer member 31, on the first guide protrusion 41 side is positioned perpendicular to the face of the attachment area 43 by the projected end 41*b* and the groove-shaped notch 41*a* of the guide protrusion.

Further, with the machine screw 37 that is fitted into the shaft hole 44*a* of the strut 44 formed on the carriage, the other end of the buffer member 31 is adjusted and set at the height of the strut 44 and is positioned perpendicular to the face of the attachment area.

Therefore, according to the second embodiment, the buffer member 31 can be easily secured to the carriage 1 with a single machine screw 37 by using a tool such as an air-powered screwdriver. Further, the buffer member 31 can be positioned at the same time in the direction in which the carriage is displaced, perpendicular to this direction and to the face of the attachment area 43. In addition, the inclination of the buffer member 31 can be uniquely determined.

The operation sequence for the thus arranged ink jet recording head is as follows. The nozzle formation face 22*a* of the recording head is sealed by the capping member 9, and the cleaning process is performed to attract and discharge ink by employing the negative pressure produced by a suction pump. Then, the carriage 1 is displaced moved in the direction indicated by the arrow B in FIG. 12, i.e., toward the printing area.

At this time, the wiping member 11 contacts the nozzle formation face 22*a*, of the recording head 22, and is bent, and while driven against the nozzle formation face 22*a* by the pressure exerted by its recovery force, slides along that surface and removes ink adhering thereto.

When the carriage 1 is further displaced in the direction indicated by the arrow B, the distal end of the wiping member 11 slides along the inclined face 32 formed in the buffer member 31, while the wiping member 11 recovers to its original shape.

Thus, the ink scraped from the nozzle formation face 22*a* is not freely splashed, and in particular, the conventional problem can be eliminated during which ink is splashed toward the capping member and contaminates the driving mechanism that moves the capping member vertically and interfered with the smooth operation of the capping member.

When the buffer member 31 is positioned on the home position side, whereat the capping member is located, it is more effective for another buffer member 31 to be positioned on the opposite side, in the direction in which the carriage 1 is displaced, so that the prevention of the splashing of ink is even more effective.

As is apparent from the explanation, according to the ink jet recording apparatus of the tenth embodiment, the buffer member having the inclined face is arranged in the attachment area that is defined between the two guide protrusions formed on the carriage, and the machine screw that passes through the through hole in the buffer member and engages the carriage side is employed to secure the buffer member to the attachment area on the carriage. Thus, since the position of the buffer member to be attached to the carriage can be easily determined, and since the attachment of the buffer member is quite easy, productivity can be increased.

Further, since at this time the protrusion of the buffer member engages the guide protrusions, the buffer member can also be positioned perpendicular to the direction in which the carriage is displaced.

In addition, the step, which contacts the projected end of one of the guide protrusions, and the protrusion, which engages the groove-shaped notch formed in the upright edges of the guide protrusion, are formed on the face and at one end of the buffer member that contacts the guide protrusion. Thus, the inclination of the buffer member relative to the carriage can be uniquely defined, so that relative the carriage, a constant incline can be maintained for the buffer member.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a carriage moving in a widthwise direction of a recording medium;

a recording head mounted on the carriage, and including a nozzle formation face having nozzle orifices from which ink drops are ejected for recording;

elastic wiping member for wiping out ink on the nozzle formation face as the carriage is moved; and a buffer member mounted on the carriage so as to be adjacent to the recording head, and having a contact face for receiving restoration force of the elastic wiping member produced by the wiping operation in order to prevent received ink from splashing therearound, wherein the contact is configured such that the distance between the nozzle formation face and the contact face of the buffer member increases so as to gradually restore the wiping member to the original shape thereof as the carriage moves.

2. The ink jet recording apparatus as set forth in claim 1, wherein the buffer member serves as an ink remover for removing the received ink on the wiping member.

3. The ink jet recording apparatus as set forth in claim 2, wherein at least the contact face of the ink remover is made of a material capable of absorbing ink.

4. The ink jet recording apparatus as set forth in claim 1, wherein the contact face is a continuous slant face.

5. The ink jet recording apparatus as set forth in claim 1, wherein the contact face is a stepwise face.

6. The ink jet recording apparatus as set forth in claim 1, wherein a plurality of individual plate members, each having different length and arranged with a predetermined interval, constitute the contact face.

7. The ink jet recording apparatus as set forth in claim 1, further comprising a capping member for capping the nozzle formation face, wherein the buffer member is located in a side close to the capping member with respect to the recording head.

8. An ink jet recording apparatus comprising:

a carriage moving in a widthwise direction of a recording medium;

a recording head mounted on the carriage, and including a nozzle formation face having nozzle orifices from which ink drops are ejected for recording;

an elastic wiping member for wiping out ink on the nozzle formation face as the carriage is moved; and a buffer member mounted on the carriage so as to be adjacent to the recording head, and having a contact face for receiving restoration force of the elastic wiping member produced by produced the wiping operation in order to prevent received ink from splashing therearound, wherein the stepwise contact face of the ink buffer member is configured so as to further deform the wiping member as the carriage moves.

9. The ink jet recording apparatus as set forth in claim 8, wherein the buffer member serves as an ink remover for removing received ink from the wiping member.

10. The ink jet recording apparatus as set forth in claim 9, wherein at least the contact face of the ink remover is made of a material capable of absorbing ink.

11. The ink jet recording apparatus as set forth in claim 8, further comprising a capping member for capping the nozzle formation face, wherein the buffer member is located in a side close to the capping member with respect to the recording head.

12. An ink jet recording apparatus comprising:

a carriage moving in a widthwise direction of a recording medium;

a recording head mounted on the carriage, and including a nozzle formation face having nozzle orifices from which ink drops are ejected for recording;

an elastic wiping member for wiping out ink on the nozzle formation face as the carriage is moved; and a buffer member mounted on the carriage so as to be adjacent to the recording head, and having a contact face for receiving restoration force of the elastic wiping member produced by the wiping operation in order to prevent received ink from splashing therearound, wherein a plurality of individual plate members are arranged with a predetermined interval so as to constitute the contact face to remove ink from the wiping member.

13. The ink jet recording apparatus as set forth in claim 12, wherein lengths of the respective plate members are made identical with each other.

14. The ink jet recording apparatus as set forth in claim 12, wherein a plate member further from the recording head has a shorter length.

15. The ink jet recording apparatus as set forth in claim 12, wherein a plate member further from the recording head has a longer length.

16. The ink jet recording apparatus as set forth in claim 12, further comprising a capping member for capping the nozzle formation face, wherein the buffer member is located in a side close to the capping member with respect to the recording head.

17. An ink jet recording apparatus comprising:

a carriage moving in a widthwise direction of a recording medium;

a recording head mounted on the carriage, and including a nozzle formation face having nozzle orifices from which ink drops are ejected for recording;

an elastic wiping member for wiping out ink on the nozzle formation face as the carriage is moved; and a buffer member mounted on the carriage so as to be adjacent to the recording head, and having a contact face for receiving restoration force of the elastic wiping member produced by the wiping operation in order to prevent received ink from splashing therearound, wherein the buffer member is mounted in an attachment area defined between a pair of guide protrusions formed on the carriage with a screw member screwed into the carriage while piercing the buffer member.

18. The ink jet recording apparatus as set forth in claim 17, wherein the position of the buffer member in the carriage moving direction is determined by the position of the pair of guide protrusions; and wherein the buffer member includes a first positioning member to be engaged with one of the guide protrusions to determine the position of the buffer member in a direction perpendicular to the carriage moving direction.

19. The ink jet recording apparatus as set forth in claim 17, wherein the buffer member includes a second positioning member to be engaged with one of the guide protrusions to determine the position of the buffer member in a direction orthogonal to a mount face of the attachment area, and a through hole, through which the screw member is inserted, formed to be adjacent to the other one of the guide protrusions in order to determine the position of the contact face.

* * * * *